United States Patent [19]

Rose et al.

[11] 4,159,743

[45] Jul. 3, 1979

[54] PROCESS AND SYSTEM FOR RECOVERING HYDROCARBONS FROM UNDERGROUND FORMATIONS

[75] Inventors: Leslie C. Rose, Rocky Mount; Joseph T. Hamrick, Roanoke, both of Va.

[73] Assignee: World Energy Systems, Fort Worth, Tex.

[21] Appl. No.: 886,104

[22] Filed: Mar. 13, 1978

Related U.S. Application Data

[63] Continuation-in-part of Ser. No. 756,129, Jan. 3, 1977, Pat. No. 4,078,613, which is a continuation of Ser. No. 602,680, Aug. 7, 1975, abandoned, which is a continuation-in-part of Ser. No. 534,778, Dec. 20, 1974, Pat. No. 3,982,591.

[51] Int. Cl.[2] ..... E21B 43/24; E21B 47/06

[52] U.S. Cl. ..... 166/302; 166/53; 166/59; 166/64

[58] Field of Search ..... 166/59, 57, 64, 260, 166/261, 300, 302, 65 R, 113; 60/39.55

[56] References Cited

U.S. PATENT DOCUMENTS

| | | | |
|---|---|---|---|
| 2,168,313 | 8/1939 | Bichowsky | 60/39.55 |
| 2,506,853 | 5/1950 | Berg et al. | 166/59 |
| 2,584,606 | 2/1952 | Merriam et al. | 166/59 X |
| 2,734,578 | 2/1956 | Walter | 166/302 X |
| 3,360,044 | 12/1967 | Lange | 166/57 X |
| 3,372,754 | 3/1968 | McDonald | 166/59 |
| 3,456,721 | 7/1969 | Smith | 166/59 |
| 3,700,035 | 10/1972 | Lange | 166/57 X |
| 3,880,235 | 4/1975 | Berry et al. | 166/302 |

*Primary Examiner*—Stephen J. Novosad
*Attorney, Agent, or Firm*—Allan R. Fowler

[57] ABSTRACT

A gas generator for use in a borehole for generating steam and other hot gases for use in recovering hydrocarbons or other fluids from underground formations. The gas generator comprises a housing forming a chamber with a combustion zone at one end and a restricted outlet at the other end. A second zone is located downstream of the combustion zone and a gas and water mixing zone is located between the second zone and the restricted outlet. The generator has a cooling annulus surrounding the chamber with passages leading from the annulus to the gas and water mixing zones. Methane is burned in the combustion zone with just enough oxygen to maintain the flame temperature below the decomposition temperature of methane to convert substantially all of the carbon to carbon monoxide and to form hydrogen. In the second zone, the carbon monoxide and hydrogen are burned with an additional supply of oxygen to increase the temperature and to form carbon dioxide and hydrogen. Water is supplied to the annulus for cooling purposes and for injection into the gas and water mixing zone for cooling the gases therein and for forming steam whereby hydrogen, steam, and carbon dioxide are injected from the restricted outlet.

In a second embodiment, hydrogen may be used as the fuel. The hydrogen is burned with just enough oxygen in the first zone to maintain a flame temperature of 1,600 to 2,000 degrees F.

2 Claims, 14 Drawing Figures

FIG. 6.
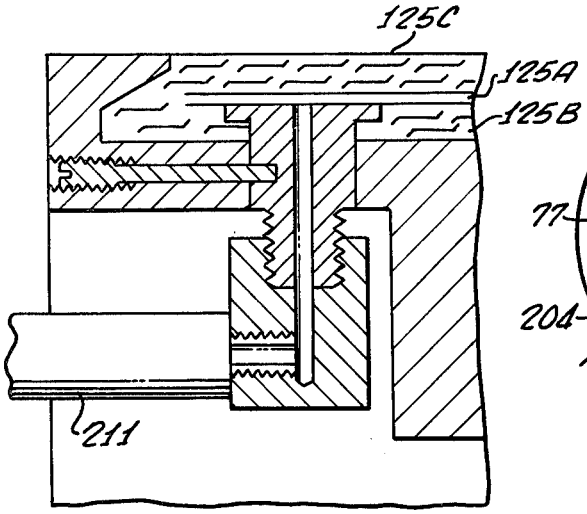
FIG. 7.
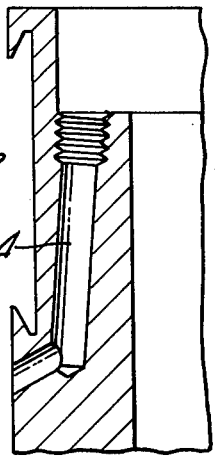
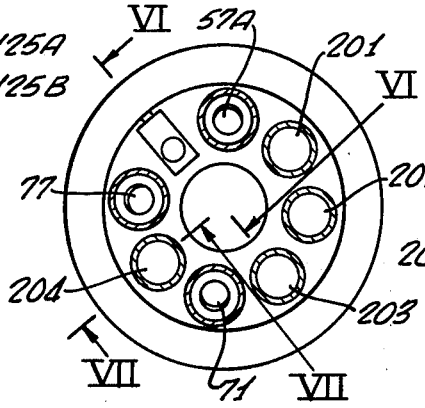
FIG. 5.
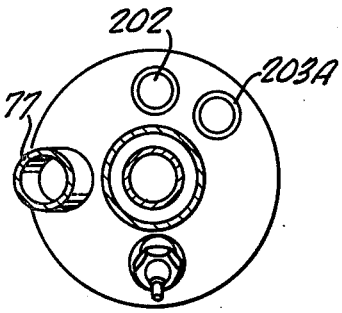
FIG. 4.
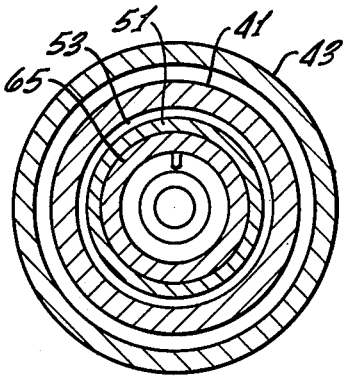
FIG. 3.
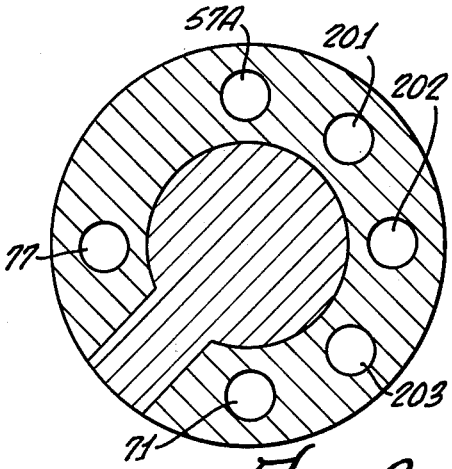
FIG. 8.
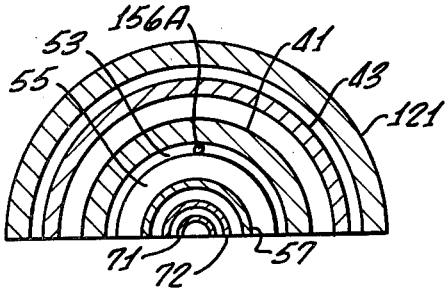
FIG. 9.
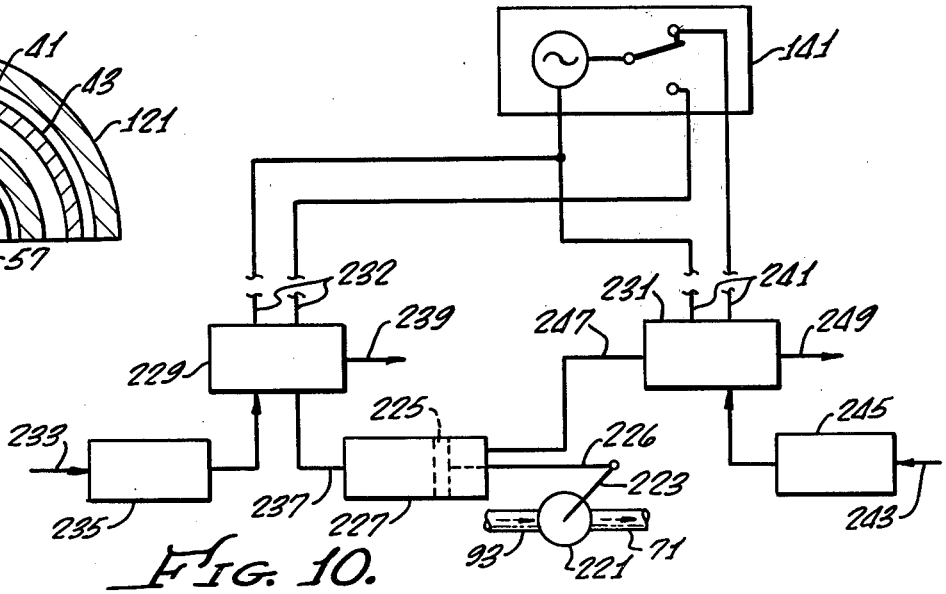
FIG. 10.

PROCESS AND SYSTEM FOR RECOVERING HYDROCARBONS FROM UNDERGROUND FORMATIONS

This Patent Application is a continuation-in-part of U.S. Patent Application Ser. No. 756,129 filed Jan. 3, 1977, now U.S. Pat. No. 4,078,613. U.S. Patent Application Ser. No. 756,129 is a continuation of U.S. Patent Application Ser. No. 602,680 filed Aug. 7, 1975, now abandoned, which is a continuation-in-part of U.S. Patent Application Ser. No. 534,778 filed Dec. 20, 1974, now U.S. Pat. No. 3,982,591.

BACKGROUND OF THE INVENTION

This invention relates to a system and process for recovery wherein hydrogen and steam and other hot gases are produced downhole with the use of a gas generator by the partial oxidation of a hydrocarbon gas.

In another embodiment of the system, hydrogen may be burned with a deficiency of oxygen followed by further combustion with additional oxygen in the presence of water to maintain maximum temperature at 1,600 to 2,000 degrees F. at any time.

SUMMARY OF THE INVENTION

It is an object of the present invention to provide an apparatus comprising a gas generator and method of operation thereof for the partial oxidation of a hydrocarbon gas at a flame temperature sufficient to prevent carbon fall out for the formation of hydrogen and carbon monoxide gases which are burned in the generator with an additional supply of oxygen to increase the temperature and to form carbon dioxide and hydrogen.

It is a further object of the present invention to provide such a gas generator that is cooled with water and which is injected into the chamber for cooling the gases and for producing steam whereby hydrogen, steam, and carbon dioxide are injected from the outlet of the gas generator.

It is another object of the present invention to provide a gas generator and method of operation thereof for borehole use for the production of hydrogen, steam, and carbon dioxide for the recovery of hydrocarbons or other fluids from underground formations.

The apparatus comprises a gas generator forming a chamber and having a combustion zone at one end, a restricted outlet at an opposite end, a second zone located downstream of the combustion zone, and a gas and water mixing zone located between the second zone and the restricted outlet. Means is provided for injecting a hydrocarbon gas and a supply of oxygen in the combustion zone for the formation of a combustible mixture of gases. Ignitor means is provided for igniting the combustible mixture of gases for the production of carbon monoxide and hydrogen. In addition, means is provided for injecting an additional supply of oxygen into the second zone of the chamber for burning the carbon monoxide and hydrogen from the combustion zone to increase the temperature and to form carbon dioxide and hydrogen for injection through the outlet. An annulus surrounds the chamber and has passages leading to the gas and water mixing zone. Means is provided for supplying water to the annulus for cooling purposes and for injection into said gas and water mixing zone by way of said passages for cooling the gases and for the formation of steam whereby hydrogen, steam, and carbon dioxide are injected from said restricted outlet. In the operation of said gas generator, the quantity of oxygen injected into said combustion zone is maintained at a level sufficient to maintain the flame temperature below the decomposition temperature of the hydrocarbon gas into carbon whereby the hydrocarbon gas is converted into carbon monoxide and hydrogen.

In the embodiment disclosed, the means for injecting the hydrocarbon gas and a supply of oxygen into said combustion zone comprises first conduit means coupled to said one end of said chamber in fluid communication with said combustion zone and second conduit means coaxial with and disposed about said first conduit means forming an annular passage in fluid communication with said combustion zone in said chamber. In addition, the means for injecting the additional supply of oxygen in said chamber comprises third conduit means coaxial with and disposed about the second conduit means forming a second annular passage in fluid communication with the interior of said chamber.

When operated in a borehole, there is provided a hydrocarbon gas supply means including conduit means extending from the surface for supplying the hydrocarbon gas to said first conduit means, and an oxygen supply means including conduit means extending from the surface for supplying oxygen to said first and third conduit means. Water from the borehole may be employed for supplying water to the cooling annulus of the chamber although if desired a separate conduit extending from the surface may be provided for supplying the water to the gas generator. In the preferred embodiment, the hydrocarbon gas employed is methane.

In another embodiment of the apparatus, hydrogen may be substituted for methane and enough oxygen supplied in the first combustion zone to raise the temperature from 1,600 to 2,000 degrees F. Part or all of the remaining hydrogen may then be burned in the second combustion zone while supplying enough water into the zone to keep the temperature at 1,600 to 2,000 degrees F.

BRIEF DESCRIPTION OF THE DRAWINGS

FIG. 3 is a cross-sectional view of FIG. 2B taken through the lines 3—3 thereof;

FIG. 4 is a cross-sectional view of FIG. 2B taken through the lines 4—4 thereof;

FIG. 5 is a cross-sectional view of FIG. 2A taken through the lines 5—5 thereof;

FIG. 6 is a cross-sectional view of FIG. 5 taken through the lines 6—6 thereof;

FIG. 7 is a cross-sectional view of FIG. 5 taken through the lines 7—7 thereof;

FIG. 8 is a cross-sectional view of FIG. 2B taken through the lines 8—8 thereof;

FIG. 9 is a cross-sectional view of FIG. 2B taken through the lines 9—9 thereof;

FIG. 10 illustrates in block diagram, one of the downhole remotely controlled valves of FIG. 1;

DETAILED DESCRIPTION OF THE INVENTION

Figure 1:
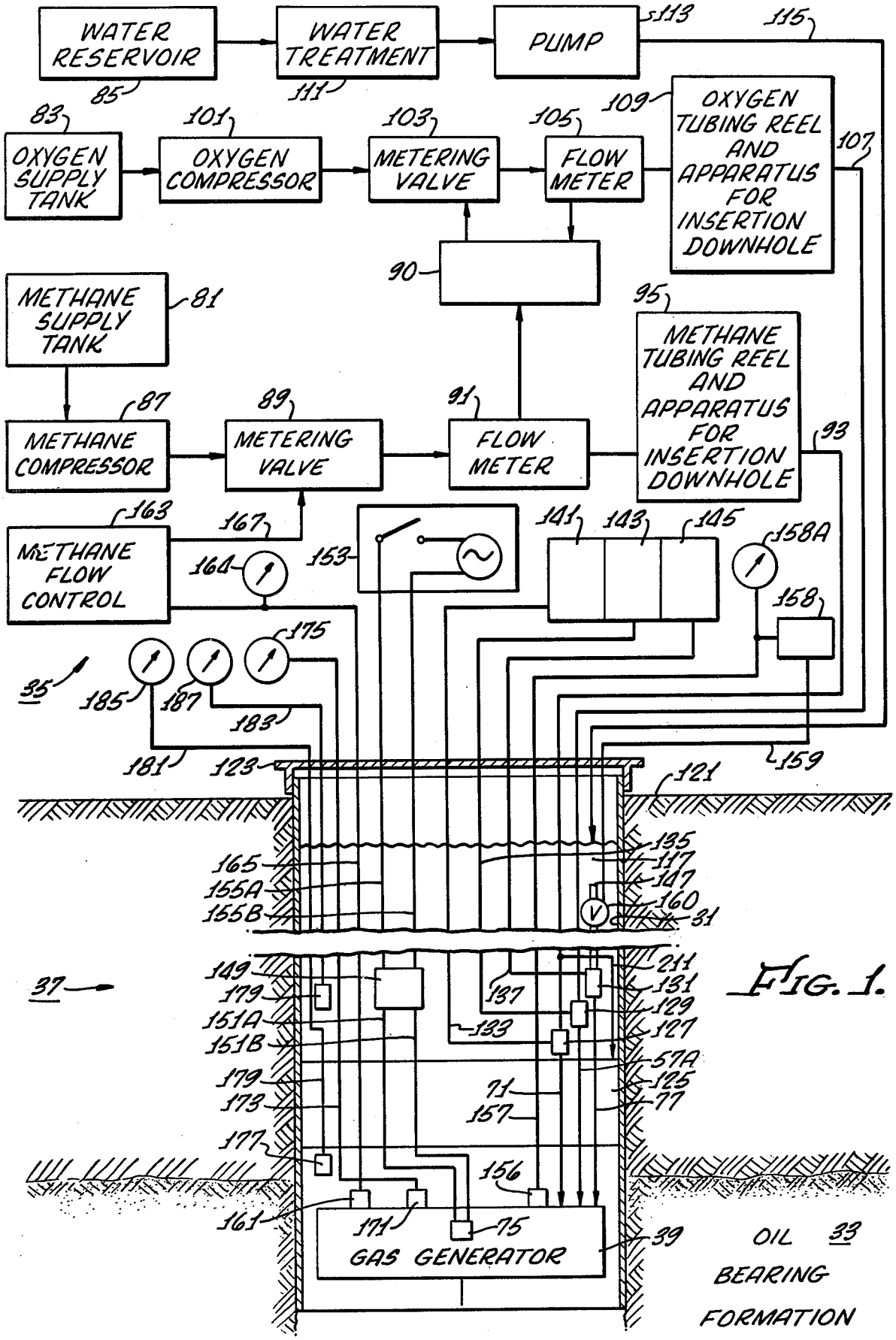
FIG. 1 schematically illustrates the uphole and downhole system of the present invention.

Referring now to FIGS. 1-9, there will be described the system of the present invention for use for generating hydrogen, steam, and carbon dioxide downhole in a borehole 31 to stimulate oil production from a subsurface reservoir 33 penetrated by the borehole (see FIG. 1). The steam and hot gases generated drive the oil in the formation 33 to other spaced boreholes (not shown) which penetrate the formation 33 for recovery purposes. The hydrogen also provides better penetration of the formation bed due to lower molecular weight of the hydrogen and acts to hydrogenate the oil to form less viscous hydrocarbons. The carbon dioxide also acts to expand the oil out of the said pores and to reduce its viscosity.

As illustrated in FIG. 1, there is provided an up hole system 35 and a downhole system 37 including a gas generator 39 to be located in the borehole at the level of or near the level of the oil bearing formation 33. Oxygen and a hydrocarbon gas which preferably is methane, are supplied from the surface to the gas generator to form a combustible mixture which is ignited and burned in the generator. The flame temperature is maintained below the decomposition temperature of the methane to prevent carbon fall-out and to convert substantially the all of the methane to carbon monoxide and hydrogen gases which are burned with an additional supply of oxygen to produce carbon dioxide and hydrogen. The gas generator and carbon dioxide and hydrogen gases generated are cooled with water which results in the production of steam whereby hydrogen, steam, and carbon dioxide are injected from the gas generator into the formations.

Figure 2A:
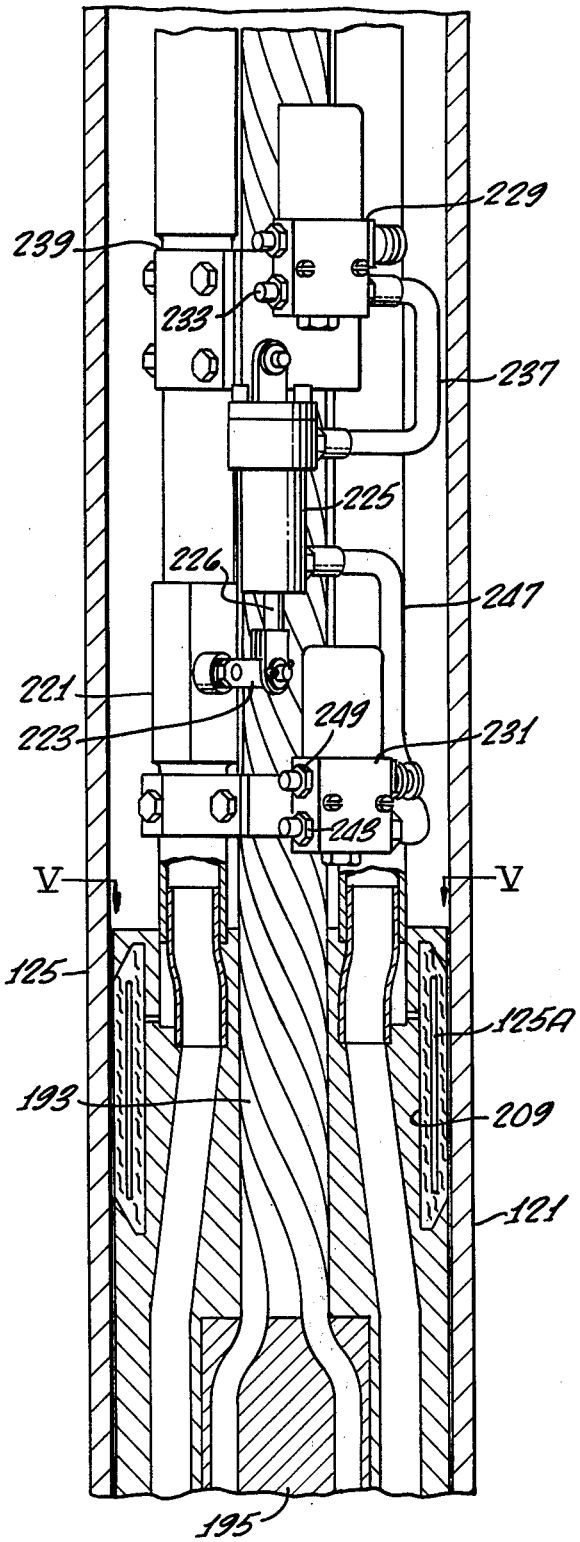
FIG. 2A is an enlarged cross-sectional view of the top portion of the downhole housing structure for supporting the gas generator of FIG. 1 in a borehole.
Figure 2B:
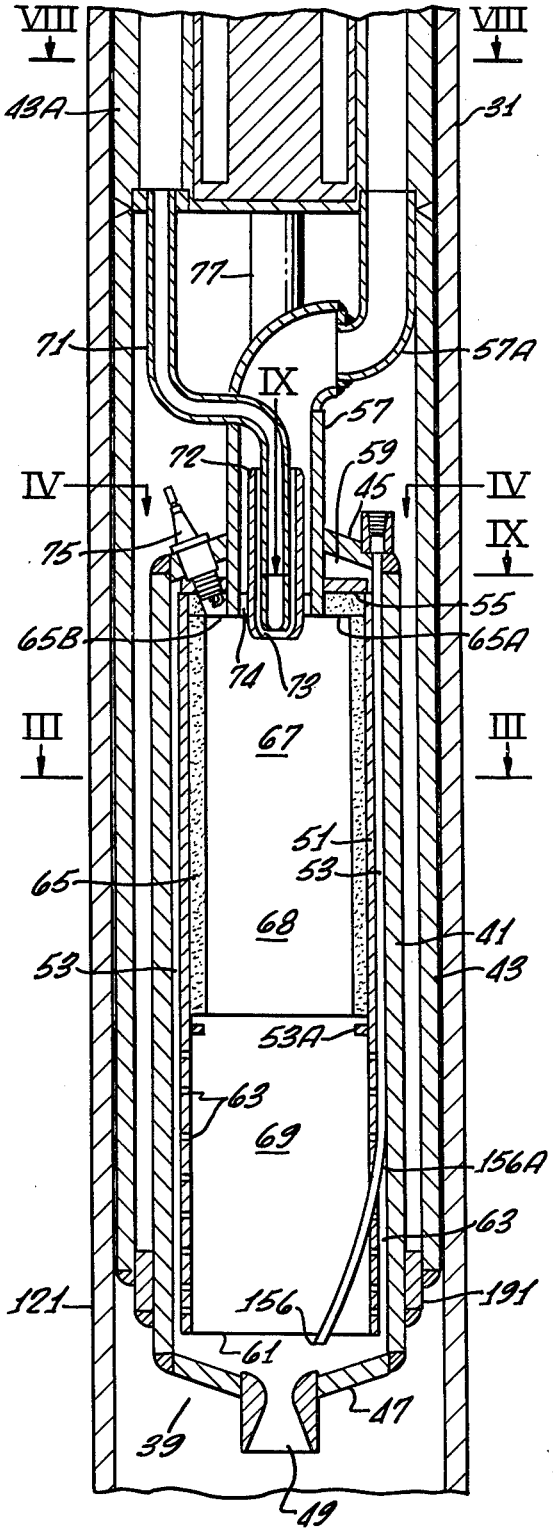
FIG. 2B is an enlarged partial cross-sectional view of the lower portion of the housing of FIG. 2A supporting the gas generator of FIG. 1. The complete housing, with the gas generator, may be viewed by connecting the lower portion of FIG. 2A to the top portion of FIG. 2B.
Figures 11, 12:
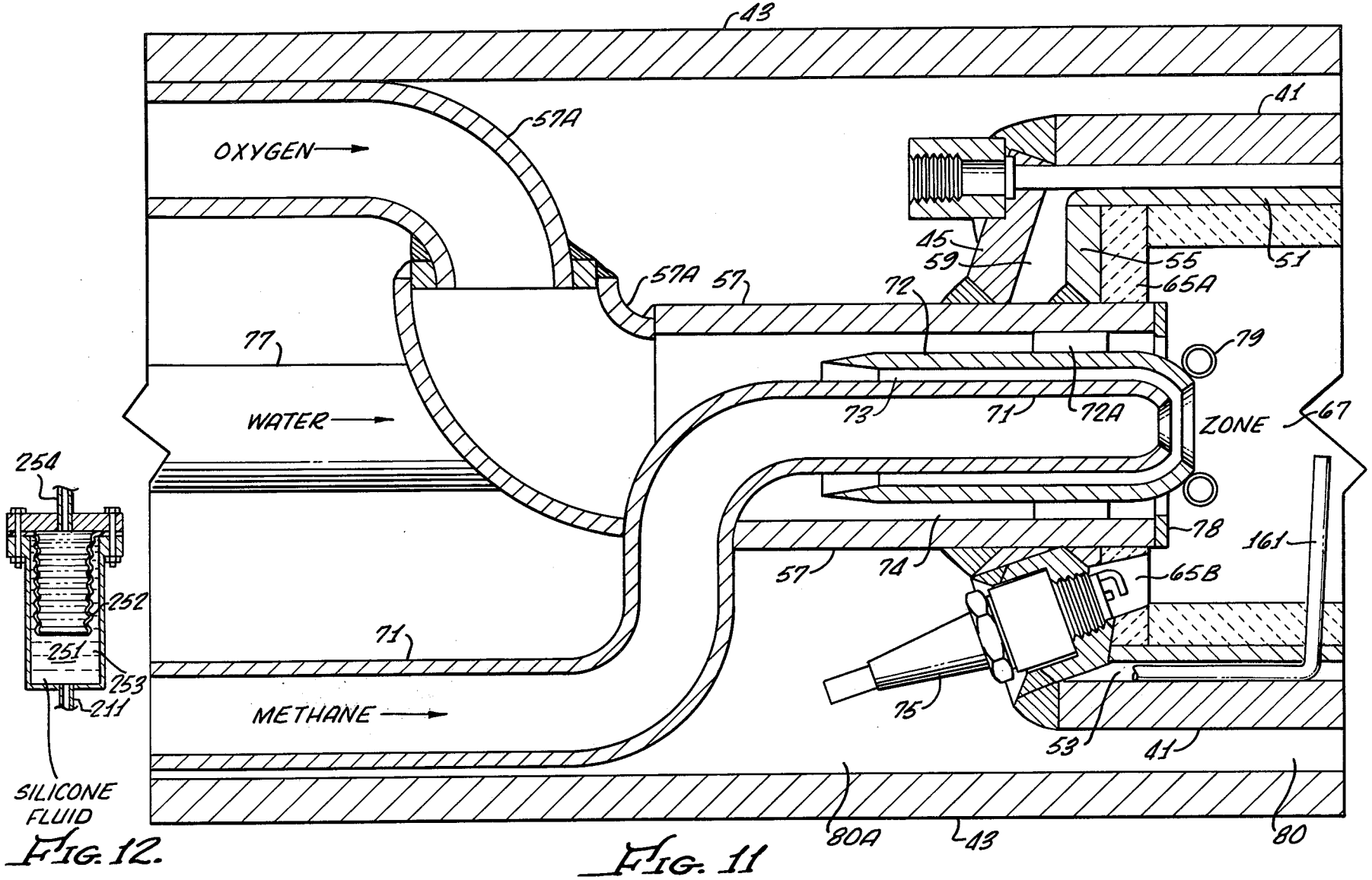
FIG. 11 is an enlarged partial cross-sectional view of the gas generator of FIG. 2B.
FIG. 12 illustrates an arrangement for inflating the packer of FIG. 2A.

Referring to FIGS. 2A, 2B, and 11, the gas generator 39 comprises an outer cylindrical shell 41 supported in a housing 43 located in the borehole. The outer shell 41 has an upper end 45 through which supply conduits and other components extend and a lower end 47 through which a small diameter outlet nozzle 49 extends. Supported within the outer shell 41 is an inner shell 51 which forms a cooling annulus 53 between the inner shell and the outer shell. The inner shell has an upper wall 55 which is connected to a conduit 57 which in turn extends through the upper wall 45 and is connected thereto. The conduit 57 forms one of the supply conduits, as will be described subsequently and also supports the inner shell 51 within the outer shell, forming the annulus 53 and also forming an upper space 59 between the walls 45 and 55. The space 59 is in communication with the annulus 53, as illustrated in FIG. 9. The opposite end of the inner shell 51 is open at 61. Formed through the inner shell at the lower end thereof are a plurality of apertures 63 which provide passages from the annulus 53 to the interior of the inner shell for the flow of cooling fluid. Supported in the inner shell at its upper end is a heat resistant liner 65 which defines a combustion zone 67 and a second zone 68 located downstream of the combustion zone. The liner is supported by a retention ring 53A and has an upper wall portion 65A through which supply conduits and other components extend. The portion of the interior shell at the level of the apertures 63 is defined as a gas and water mixing zone 69.

Conduit 57 extends through walls 45 and 55 and through the upper liner wall 65A to the inside of the liner 65. Coaxially located within the conduit 57 and spaced inward therefrom are two coaxial conduits 71 and 72 which are spaced from each other and extend to the combustion zone 67. Conduit 72 is held in place by spacers 72A (FIG. 11) connected between conduits 57 and 72. A first annular passage 73 is formed between coaxial conduits 71 and 72 and a second annular passage 74 is formed between coaxial conduits 72 and 57. Methane is introduced into the combustion zones 67 of the gas generator through the conduit 71 and oxygen is supplied through conduit 57A which is connected to conduit 57. The oxygen splits into two paths for flow through the two annular passages 73 and 74. Oxygen flowing through the annular passage 73 flows into the combustion zone 67 where it combines with the methane to form a combustible mixture of gases in the combustion zone. The combustible mixture of gases is ignited by an ignitor 75 and burned. Just enough oxygen is provided through annular passage 73 to keep the temperature of combustion below 1200° F. in the flame front whereby substantially all of the carbon in the methane will react with the oxygen producing carbon monoxide and free hydrogen. Thus carbon fall-out is prevented or minimized which is desireable since the carbon may otherwise pack the combustion chamber and in downhole operation clog the sand face.

The overall temperature in the combustion zone is about 2400° F. In order to obtain more BTU per pound of each of methane and oxygen and hence to reduce the cost of methane and oxygen required, higher temperatures are desired. Increased temperatures are obtained by providing an additional supply of oxygen to burn the carbon monoxide and hydrogen. The additional supply of oxygen is added by way of the second annular passage 74. Oxygen thus flowing through annular passage 74 flows into the second zone 68 where the carbon monoxide and hydrogen from zone 67 are burned with the additional supply of oxygen which increases the temperature to about 3800° F. to 4000° F. and results in the production of carbon dioxide and hydrogen. The gases from zone 68 flow to zone 69 where they are cooled with water to approximately 544° F. before injection into the reservoir. Enough water will be added to produce 80% quality steam at a chamber pressure of 1000 psia for injection along with the hydrogen and carbon dioxide. (Steam quality is percent of water in vapor form). Water is supplied to the annulus 53 by way of a conduit 77 (see also FIG. 4) extending through the upper wall 45 of the outer shell 41. From conduit 77, the water flows to the annulus 53 by way of a space 59 formed between the walls 45 and 55. The water cools the inner shell 51 and flows through apertures 63 to cool the combustion gases and form steam. The mixture of water vapor, water droplets, hydrogen and carbon dioxide passes through the outlet nozzle 49 into the formation. Since the exhaust nozzle 49 is small compared with the diameter of the interior of the chamber, the pressure generated in the generator is not significantly affected by the external pressure (pressure of the oil reservoir) until the external pressure approaches approximately 80% of the value of the internal pressure. Therefore, for a set gas generator pressure, there is no need to vary the flow rate of the ingredients into the generator until the external pressure (oil reservoir pressure) approaches approximately 80% of the internal gas pressure.

The lowest ratio of oxygen to methane in the combustion zone that will convert all of the carbon to carbon monoxide is about 1.1 pound of oxygen to one pound of methane. The amount of oxygen used in the second process in zone 68 will depend upon the amount required to convert all of the carbon monoxide to carbon dioxide, the maximum specified temperature, and the amount of hydrogen that is desired to inject through the sand face into the oil reservoir. The division of flow of oxygen to passages 73 and 74 is adjusted experimentally by means of an orifice plate 78 (FIG. 11) which can be sized to cover as much of the exit of the annular passage 74 as required. Although not shown, swirl vanes are provided at the end of the passage 74 to swirl and centrifuge the oxygen flowing through passage 74 outward past the zone 67 to the second zone 68. If desired swirl vanes may be provided at the end of conduit 71 and at the end of annular passage 73 to swirl the methane and oxygen in opposite directions to insure adequate mixing to form the desired combustible mixture in zone 67. Referring to FIG. 11, a cooling tube 79 for the passage of water is provided for cooling the burner tip. The housing or jacket 43 enclosing the gas generator forms an annulus 80 with the outer wall 41 of the generator. Water is provided in the annulus 80 and heat from the generator raises the water temperature in the annulus 80 which is then mixed by convection with the water in the chamber 80A above the generator to heat the conduits 57A and 71. These conduits may be coiled if desired to provide adequate surface area to preheat the methane and oxygen.

Referring to FIG. 1, the methane, oxygen, and water are supplied to the generator located downhole by way of a methane supply 81, an oxygen supply 83, and a water supply 85. Methane is supplied by way of a compressor 87 and then through a metering valve 89, a flow meter 91, and through conduit 93 which is inserted downhole by a tubing reel and apparatus 95. Oxygen is supplied downhole by way of a compressor 101, and then through a metering valve 103, a flow meter 105, and through conduit 107 which is inserted downhole by way of a tubing reel and apparatus 109. From the water reservoir 85, the water is supplied to a water treatment system 111 and then pumped by pump 113 through conduit 115 into the borehole 31. In FIG. 1, water in the borehole is identified at 117.

The borehole 31 is cased with a steel casing 121 and has an upper well head 123 through which all of the conduits, leads, and cables extend. Located in the borehole above and near the gas generator is a packer 125 through which the conduits, cables, and leads extend. The flow of methane, oxygen, and water to the generator is controlled by solenoid actuated valves 127, 129, and 131 which are located downhole near the gas generator above the packer. Valves 127, 129, and 131 have leads 133, 135, and 137 which extend to the surface to solenoid controls 141, 143, and 145 for separately controlling the opening and closing of the downhole valves from the surface. The controls 141, 143, and 145 in effect, are switches which may be separately actuated to control the application of electrical energy to the downhole coils of the valves 127, 129 and 131. Valve 127 is coupled to methane conduits 93 and 71 (FIG. 2B) while valve 129 is coupled to oxygen conduits 107 and 57A (FIG. 2B). Valve 131 is coupled to water conduit 77 (FIG. 2B) and has an inlet 147 (FIG. 1) for allowing the water in the casing to flow to the gas generator when the valve 131 is opened.

As shown in FIG. 2B, the igniter 75 comprises a spark plug or electrode which extends through walls 45 and 55 and into an aperture 65B formed through the upper liner wall 65A whereby it is exposed to the gases in the combustion zone 67. The igniter 75 is coupled to a downhole transformer 149 by way of leads 151A and 151B (FIG. 1). The transformer is coupled to an uphole ignition control 153 by way of leads 155A and 155B. The uphole ignition control 153 comprises a switch for controlling the application of electrical energy to the downhole transformer 149 and hence to the igniter 75. A thermocouple 161 is supported by the gas generator in the combustion zone 67 and is electrically coupled to an uphole methane flow control 163 by way of leads illustrated at 165. The methane flow control senses the temperature detected by the thermocouple and produces an output which is applied to the metering valve 89 for controlling the flow of methane to obtain the desired methane-oxygen ratio. The output from the flow control 163 may be an electrical output or a pneumatic or hydraulic output and is applied to the valve 89 by way of a lead or conduit illustrated at 167. A second thermocouple 156 is supported by the gas generator near the restricted outlet 49 (FIG. 2B) to sense the temperature of the gases flowing out of the outlet 49. Its outlet is applied uphole by way of leads 157 to an electrical power supply and control system 158, the output of which is coupled by way of leads 159 to an electrically controlled torque motor valve 160 coupled in the water inlet 147. This arrangement is provided to control the size of the opening of valve 160 to control the amount of water flowing to the annulus 53 and hence through passages 63 to control the temperature of the gases flowing from the generator outlet 49. A meter 158A is also coupled to the leads uphole to allow the operator to obtain a visual reading of the gas temperature at the generator outlet 49 to allow manual control if desired through control system 158. In the alternative, valve 160 may be eliminated by controlling the water flow through conduit 115 at the surface so as to adjust the water column in the casing of deep wells to a height which will induce the desired flow through the generator. For shallow wells, control may be obtained by adjusting the pump output pressure.

Also supported by the gas generator is a pressure transducer 171 located in the space between the gas generator and packer for sensing the pressure in the generator. Leads illustrated at 173 extend from the transducer 171 to the surface where they are coupled to a meter 175, for monitoring purposes. Also provided below and above the packer are pressure transducers 177 and 179 which have leads 181 and 183 extending to the surface to meters 185 and 187 for monitoring the pressure differential across the packer.

Referring again to FIGS. 2A and 2B, the gas generator 39 is secured to the housing 43 by way of an annular member 191. The housing in turn is supported in the borehole by a cable 193. As illustrated, cable 193 has its lower end secured to a zinc lock 195 which is secured in the upper portion 43A of the housing. As illustrated in FIGS. 4, 5, and 8, the upper portion of the housing has conduits 77, 57A, 201-203, 71 and 204 extending therethrough for the water, oxygen, igniter wires, thermocouple wires, pressure lines, methane, and a dump conduit, the latter of which will be described subsequently. The upper portion of the housing also has an annular slot 209 formed in its periphery in which is supported the packer 125. The packer is an elastic member that may be expanded by the injection of a fluid into an inner annulus 125A formed between the inner and outer portions 125B and 125C of the packer. (See also FIG. 6.) In the present embodiment, oxygen from the oxygen conduit is employed to pressurize a silicone fluid to inflate the packer to form a seal between the housing 43A and the casing 121 of the borehole.

Referring to FIGS. 6 and 12, the packer 125 may be inflated with a silicone fluid 251 located in a chamber 252 and which is in fluid communication with the packer annulus 125A by way of conduit 211. The chamber 252 contains a bellows 253 which may be expanded by oxygen supplied through inlet 254, which is coupled to the oxygen conduit 107, to force the silicone fluid 251 into the packer annulus 125A when the oxygen is admitted into the conduit 107. This arrangement has advantage since the silicone fluid will not adversely affect the packer.

With the downhole system in place in the borehole, as illustrated in FIG. 1, and all downhole valves closed, the start-up sequence is as follows. Methane and oxygen are admitted to the downhole piping and brought up to pressure by opening metering valves 89 and 103. The oxygen pressurizes the silicone fluid in chamber 252 to inflate the packer 125 and form a seal between the housing 43A and the borehole casing 121, upon being admitted to the downhole piping 107. Water, then is admitted to the well casing and the casing filled or partially filled. This is accomplished by actuating pump 113. Water further pressurizes the downhole packer seal. The ignition control 153 and the methane, oxygen, and water solenoid valves 127, 129, and 131 are set to actuate, in the proper sequence, as follows. The igniter is started by actuating control 153; the oxygen valve 129 is opened by actuating control 143 to give a slight oxygen lead; the methane valve 127 is then opened, followed by the opening of the water valve 131. Water valve 160 is always open but the size of its opening may be varied to control the amount of water flowing through annulus 53 as indicated above. Valves 127 and 131 are opened by actuating controls 141 and 145 respectively. This sequence may be carried out by manually controlling controls 141, 143, 145 and 153 or by automatically controlling these controls by an automatic uphole control system. At this point, a characteristic signal from the downhole pressure transducer 171 will show on meter 175 whether or not a normal start was obtained and the thermocouples 156 and 161 will show by meters 158A and 164 whether or not the desired temperatures are being maintained. The methane flow controller 163 is slaved to thermocouple 161 which automatically controls the methane flow. Similarly the control system 158 is slaved to the thermocouple 156 which automatically controls the water flow to annulus 53. The methane to oxygen ratio may be controlled by physically coupling the methane and oxygen valves, electrically coupling the valves with a self synchronizing motor or by feeding the output from flow meters 105 and 91 into a comparator 90 which will provide an electrical output for moving the oxygen metering valve in a direction that will keep the methane-oxygen ratio constant. The comparator may be in the form of a computer which takes the digital count from each flow meter, computes the required movement of oxygen metering valve and feeds the required electrical, pneumatic, or hydraulic power to the valve controller to accomplish it. Such controls are available commercially. The flow rate through the metering valve 89 is controlled by electrical communication through conduit 167 from the methane flow controller 163. Communication from the methane flow controller 163 to metering valve 89 optionally may be by pneumatic or hydraulic means through an appropriate conduit. At this point, the flow quantities of methane, oxygen, and water are checked to ascertain proper ratios of methane and oxygen, as well as flow quantities of methane, oxygen, and water. Monitoring of the flow of methane and oxygen is carried out by observing flow meters 91 and 105. The amount of oxygen flowing through annular passage 74 to zone 68 in the gas generator can be ascertained by obtaining the differential in oxygen flow reflected by the uphole meter 158A of the thermocouple 156 and the oxygen flow read from uphole meter 105. The flow rate meters or sensors 91 and 105 in the methane and oxygen supply lines at the surface also may be employed to detect pressure changes in the gas generator. For example, if the gas generator should flame out, the flow rates of fuel and oxidizer will increase, giving an indication of malfunction. If the reservoir pressure should equal the internal gas generator pressure, the flow rates of the fuel and oxidizer would drop, signaling a need for a pressure increase from the supply. Adjustment of the flow quantities of methane and oxygen can be made by adjusting the supply pressure. Both valves 89 and 103 may be adjusted manually to the desired initial set value.

At this point, the gas generator is on stream. As the pressure below the packer builds up, there may be a tendency for the packer to be pushed upward and hot gases to leak upward into the well casing both of which are undesirable and potentially damaging. This is prevented, however, by the column of water maintained in the casing and which is maintained at a pressure that will equal or exceed the pressure of the reservoir below the packer. For shallow wells, it may be necessary to maintain pressure by pump 113 in addition to that exerted by the water column. For the deep wells, it may be necessary to control the height of the water column in the casing. This may be accomplished by inserting the water conduit 115 in the borehole to an intermediate depth with a float operated shut off valve; by measuring the pressures above and below the packer; by measuring the pressure differential across the packer; or by measuring the change in tension of the cable that supports the packer and gas generator as water is added in the column. Flow of water into the casing 121 will be shut off if the measurement obtained becomes too great. Water cut-off would be automatic. In addition, a water actuated switch in the well may be employed to terminate flow after the well is filled to a desired height. The pressure and pressure differential can be sensed by commercially available pressure transducers, such as strain gages, variable reluctance elements or piezoelectric elements, which generate an electrical signal with pressure change. Changes in the cable tension can be sensed by a load cell supporting the cable at the surface. In the embodiment of FIG. 1, pressure above and below the packer is measured by pressure transducers 177 and 179, the outputs of which are monitored by meters 185 and 187 for controlling flow of water into the casing 121. On stream operation of the gas generator may extend over periods of several weeks.

In shut down operations, the following sequence is followed. The downhole oxygen valve 129 is shut off first, followed by shut off of the methane valve 127 and then the water valve 131. The water valve should be allowed to remain open just long enough to cool the generator and eliminate heat soak back after shut down. Shut off of the igniter is accomplished manually or by timer after start-up is achieved.

In one embodiment the downhole generator may be employed in a borehole casing having an inside diameter of 6.625 inches. The well casing can be used for the supply of water. Where the water places excessive stress on the suspension system, the water depth in the casing must be controlled, as indicated above. The column pressure of water at 5,000 feet is 2,175 psi. No pumping pressure is needed at this depth. Instead, a pressure regulator orifice will be employed at the well bottom to reduce the pressure at the gas generator. Water is fed directly from the supply in the well casing to the regulator orifice.

It is necessary for start-up and operation of the gas generator to locate the valves downhole just above the packer to assure an oxygen lead at start-up and positive response to control. Use of the downhole remotely controlled valves 127, 129, and 131 has advantages in that it prevents premature flooding of the gas generator. The downhole valves 127, 129, and 131 may be cylinder actuated ball type valves which may be operated pneumatically or hydraulically (hydraulically in the embodiment of FIG. 1), using solenoid valves to admit pressure to the actuating cylinder. Where the well casing is used as one of the conduits for water, it will be necessary to exhaust one port of the solenoid valves below the downhole packer. Further, for more positive actuation, it may be desirable to use unregulated water pressure as the actuating fluid, as it will provide the greatest pressure differential across the packer. A schematic diagram of the valve arrangement for each of the valves 127, 129, and 131 of FIG. 1 is illustrated in FIG. 10. In this FIGURE, the valve 127 is identified as valve 221. The valves 129 and 131 will be connected in a similar manner. As illustrated, the valve shown in FIG. 10 comprises a ball valve 221 for controlling the flow of fluid through conduit 71. The opening and closing of the ball valve is controlled by a lever 223 which in turn is controlled by a piston 225 and rod 226 of a valve actuating cylinder 227. Two three-way solenoid valves 229 and 231 are employed for actuating the cylinder 227 to open and close the ball valve 211. As illustrated, the three-way solenoid valve 229 has electrical leads 232 extending to the surface and which form a part of leads 133 of FIG. 1. It has a water inlet conduit 233 with a filter and screen 235; an outlet conduit 237 coupled to one side of the cylinder 227; and an exhaust port 239. Similarly, the valve 231 has electrical leads 241 extending to the surface and which also form a part of leads 133 of FIG. 1. Valve 231 has a water inlet conduit 243 with a filter and screen 245 coupled therein; an outlet conduit 247 coupled to the other side of the cylinder 227; and an exhaust port 249. Both of ports 239 and 249 are connected to the dump cavity 204 which extends through the upper housing portion 43A from a position above the packer to a position below the packer. Hence, both ports 239 and 249 are vented to the pressure below the packer 125. In operation, valve 229 is energized and valve 231 de-energized to open ball valve 211. In order to close ball valve 221, valve 229 is de-energized and valve 231 enerzized. When solenoid valve 229 is energized and hence opened, water pressure is applied to one side of the cylinder 227 by way of conduit 233, valve 229, and conduit 237 to move its piston 225 and hence lever 223 to a position to open the ball valve 221 to allow fluid flow through conduit 71. When valve 231 is de-energized and hence closed, the opposite side of the cylinder 227 is vented to the pressure below the packer by way of conduit 247, valve 231 and conduit 249. When valve 231 is opened, water pressure is applied to the other side of the cylinder by way of conduit 243, valve 231 and conduit 247 to move the actuating lever 223 in a direction to close the valve 221. When valve 229 is closed, the opposite side of the cylinder is vented to the pressure below the packer by way of conduit 237, valve 229, and conduit 239.

Referring again to the packer 125, initial sealing is effected by pneumatic pressure on the seal from the oxygen pressure and finally from pressure exerted by the water column. Thus, the packer uses pneumatic pressure to insure an initial seal so that the water pressure will build up on the top side of the seal. Once the water column in the casing reaches a height adequate to hold the seal out against the casing, the pneumatic pressure is no longer needed and the hydraulic pressure holding the seal against the casing increases with the water column height. Hence, with water exerting pressure on the pneumatic seal in addition to the sealing pressure from the oxygen and silicone fluid, there will be little or no leakage past the packer. More important, however, is the fact that no hot gases will be leaking upward across the packer since the down side is exposed to the lesser of two opposing pressures. In addition to maintaining a positive pressure gradient across the packer, the water also acts as a coolant for the packer seal and components above the packer. The seal may be made of viton rubber or neoprene. The cable suspension system acts to support the gas generator and packer from the water column load. In one embodiment, the cable may be made of plow steel rope.

In one embodiment, the outer shell 41 (FIG. 2B) and the inner shell 51 of the gas generator may be formed of 304 stainless steel. The wall of the outer shell 41 may be $\frac{3}{8}$ of an inch thick while the wall of the inner shell 51 may be $\frac{1}{8}$ of an inch thick. The liner 65 may be formed of graphite with a wall thickness of 5/16 of an inch. It extends along the upper 55% of the inner shell. As the inner shell 51 is kept cool by the water, it will not expand greatly. The graphite also will be cooled on the outer surface and therefore will not reach maximum temperature. The thermocouple 156 is housed in a sheath of tubing 156A running from the top of the generator through the annulus to a point near the exhaust nozzle 49 and senses the temperature at that point. The leads of the thermocouple 156 extend through conduit 202 of the housing (FIG. 8) and at 157 (FIG. 1) to the surface. The thermocouple 161 is located in the zone 68 and also is housed in a sheath which extends through the annulus 53 and through a conduit of the housing (not shown) to the leads 165 which extend to the surface. The pressure transducer 171 (FIG. 1) allows monitoring of the generator pressure. It is located in the space between the generator and packer and is connected to the generator at 203A (FIG. 4). The transducer 171 has leads 173 extending through conduit 203 of the housing to the surface. The diameters of the methane and oxygen inlet tubes 57 and 71 are sized to obtain the desired flow thereof. The area of the exhaust nozzle for a nozzle coefficient of 100% is 0.332 inches square. For a nozzle coefficient of 0.96, the area is 0.346 inches square for a diameter of 0.664 of an inch. The inside diameter of the outer shell 41 may be 4.3 inches, and the inside diameter of the inner shell 3.65 inches. For these dimensions, the nozzle 49 may have a minimum inside diameter of 0.664 of an inch. With the high pressures that are associated with a gas generator, a plug (not shown) can be inserted in the nozzle 49 before the generator is lowered into the borehole, so that it can be blown out upon start-up of the gas generator. The plug will be employed to prevent borehole liquid from entering the generator when it is lowered in place in the borehole. Further, because of the continued availability of high pressure and small area required, a check valve downstream of the nozzle can be provided so that upon shut down of the gas generator, the check valve will close, keeping out any fluids which could otherwise flow back into the generator.

Although not shown, it is to be understood that suitable cable reeling and insertion apparatus will be employed for lowering the gas generator into the borehole by way of cable 193. In addition, if the water conduit 115 is to be inserted into the borehole to significant depths, suitable water tubing reel and apparatus similar to that identified at 95 and 109 will be employed for inserting the water tubing downhole.

The methane and oxygen metering valves 89 and 103 will have controls for manually presetting the valve openings for a given methane-oxygen ratio. Valve 103 is slaved to valve 89, as indicated above. The valve openings may be changed automatically for changing the flow rates therethrough by the use of hydraulic or pneumatic pressure or by the use of electrical energy. If the metering valves are of the type which are actuated by hydraulic or pneumatic pressure, they may include a spring loaded piston controlled by the hydraulic or pneumatic pressure for moving a needle in or out of an orifice. If the metering valves are of the type which are actuated electrically, they may include an electric motor for controlling the opening therethrough. Suitable metering valves 89 and 103 may be purchased commercially from companies such as Allied Control Co., Inc. of New York, N.Y., Republic Mfg. Co. of Cleveland, Ohio, Skinner Uniflow Valve Div. of Cranford, New Jersey, etc.

In the embodiment of FIG. 1, valve 89 is actuated automatically by thermocouple signal. The downhole thermocouple 156 produces an electrical signal representative of temperature and which is applied to the methane flow control 163. If the metering valve 89 is electrically activated, the methane flow control produces an appropriate electrical output, in response to the thermocouple signal, and which is applied to the valve by way of leads 167 for reducing or increasing the flow rate therethrough. If the valve 89 is hydraulically or pneumatically actuated, the methane flow control 163 will convert the thermocouple signal to hydraulic or pneumatic pressure for application to the valve 89 for control purposes.

The flow meters 91 and 105 may be of the type having rotatable vanes driven by the flow of fluid therethrough. The flow rate may be determined by measuring the speed of the vanes by the use of a magnetic pickup which detects the vanes upon rotation past the pickup. The output count of the magnetic pickup is applied to an electronic counter for producing an output representative of flow rate.

If a stoichiometric mixture of methane and oxygen were burned to produce carbon dioxide and water, the final temperature of the exhaust gases will be greater than 5000° F. which is greater than desired for prolonged operation of the gas generator in downhole operations. By partially oxidizing methane at a lower temperature to form the stable gases carbon monoxide and hydrogen, and then by burning these gases with an additional supply of oxygen, it can be understood that the desired gases can be produced without carbon fallout and at a temperature that is sufficient to obtain a high BTU per pound of each of methane and oxygen and that can be withstood by the gas generator.

In a further embodiment butane or propane may be used instead of methane in the gas generator to produce carbon monoxide and hydrogen by partial oxidation and which are converted to carbon dioxide and hydrogen by burning with an additional supply of oxygen. Preferably the supply pressures for butane and propane would be lower than that of methane.

In FIG. 2B the orifice plate 78 and cooling tube 79 are not shown for purposes of clarity. Water is supplied to the cooling tube 79 by way of conduits (not shown) coupled to the water in the borehole above the packer and extending through the housing within the packer to the tube 79. Similarly water is supplied to the annulus 80 by way of conduits (not shown) coupled to the water in the borehole above the packer and extending through the housing within the packer.

Figure 13:
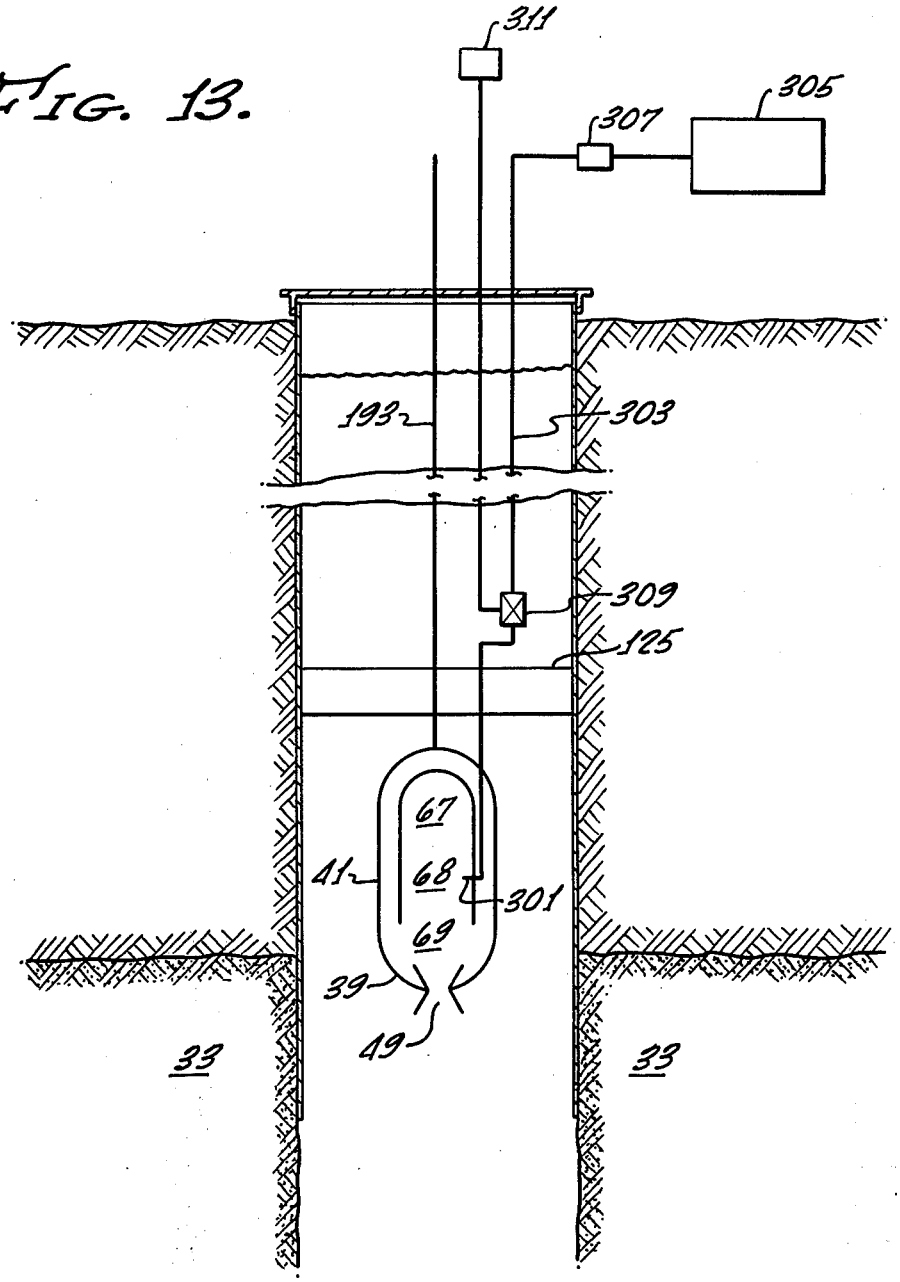
FIG. 13 schematically illustrates water nozzles and controls for the second zone of another embodiment of the gas generator. For purposes of clarity this Figure does not illustrate the other components of the system which are shown in the other Figures.

In a further embodiment of the generator, hydrogen may be used as a fuel in place of methane or other hydrocarbon gas. The objective of using this embodiment is to burn just enough oxygen with the hydrogen to raise the temperature in the initial combustion zone to approximately 2,000 degrees F., a temperature that can be withstood by available construction material. As these gases move downward in the chamber, they are hot enough so that when water droplets and oxygen are simultaneously injected into the second zone combustion of the remaining hydrogen will be sustained and cooling due to evaporation of the water will allow the desired 2,000 degrees F. maximum temperature to be maintained. In this embodiment a hydrogen supply will be substituted for the methane supply 81. Referring to FIG. 2B, the hydrogen is fed through conduit 71 and oxygen is fed through conduits 73 and 74. The liners 65 and 65A are not required if the water cooled inner shell 51 is fabricated from 310 stainless steel which can withstand the 2,000 degrees F. temperature. To maintain close temperature control, separate water injection nozzels 301 (FIG. 13) are installed in the wall of inner shell 51 at the level of the second zone 68. A water conduit 303 extends from a water supply 305 at the surface and passes through the packer 125 with a regulating valve control 307 at the surface to supply water to the nozzels as required in the second zone. The temperature as sensed by thermocouple 161 (FIG. 1) provides the signal for water regulation. A valve 309 controllable from the surface by control 311 will be coupled to the water conduit 303 near the gas generator. The valve 309 may be similar to valves 127, 129, and 131 and will be employed to allow or terminate flow of water to the nozzles 301.

Thus in this embodiment there is burned an excess of hydrogen with oxygen in the first zone 67 of the downhole gas generator at 1,600 to 2,000 degrees F. so that as the resulting mixture of hot hydrogen and steam moves into the second zone 68, the hydrogen will spontaneously ignite when a mixture of oxygen and water droplets is supplied into the hot mixture. The water droplets evaporate keeping the spontaneously ignited gases at a temperature between approximately 1,600 and 2,000 degrees F., a temperature which can be withstood by available construction materials.

The output of the gas generator will be hot gases and steam and excess hydrogen, if desired for insitu hydrogenation. The amount of hydrogen needed for insitu hydrogenation determines the portion of the hydrogen to be burned in the second zone 68.

We claim:

1. In a recovery process for recovering hydrocarbons or other fluids from underground formations penetrated by a borehole and wherein a gas generator is located in the borehole at or near the level of said formations, said gas generator comprising:

a housing forming a chamber with a combustion zone at one end, a restricted outlet at an opposite end, a second zone located downstream of said combustion zone, and a gas and water mixing zone located between said second zone and said restricted outlet, the method of operating said gas generator comprising the steps of:

flowing through said borehole from the surface to said gas generator, by way of separate passages, hydrogen and oxygen, injecting said hydrogen and oxygen into said combustion zone to form a combustible mixture of gases, igniting and burning said combustible mixture in said combustion zone, injecting an additional supply of oxygen into said second zone to burn additional hydrogen from said first zone while supplying water into said second zone to maintain the temperature below a predetermined maximum value, and flowing water into said gas and water mixing zone for the formation of steam whereby hot gases and steam are injected from said restricted outlet for flow into said formations.

2. A system including a gas generator for generating in a borehole, hot gases and steam, for recovering hydrocarbons and other fluids from underground formations penetrated by the borehole, comprising:

a gas generator located in the borehole at or near the level of said formations, said gas generator comprising:

a housing forming a chamber and having a combustion zone at one end, a restricted outlet at an opposite end, a second zone located downstream of said combustion zone, and a gas and water mixing zone located between said second zone and said restricted outlet, first conduit means coupled to said one end of said chamber for injecting hydrogen into said combustion zone, second conduit means coupled to said one end of said chamber for injecting oxygen into said combustion zone for forming a combustible mixture of gases therein for ignition, third conduit means for injecting an additional supply of oxygen into said second zone of said chamber for burning additional hydrogen from said combustion zone, means for injecting water into said second zone for maintaining the temperature below a predetermined value, hydrogen supply means, including conduit means, extending from the surface for supplying hydrogen to said first conduit means, oxygen supply means, including conduit means, extending from the surface of supplying oxygen to said second and third conduit means, means including conduit means, for supplying water for injection into said gas and water mixing zone for the formation of steam whereby hot gases and steam are injected from said restricted outlet into the formations.

* * * * *